US006349651B1

(12) United States Patent
Martinez Garcia

(10) Patent No.: US 6,349,651 B1
(45) Date of Patent: Feb. 26, 2002

(54) SPINNING AND EXPLODING PROJECTILE

(76) Inventor: Juan Martinez Garcia, Bendicto XV, 28-30, 14400 Pozoblanco Córdoba (ES)

( * ) Notice: Subject to any disclaimer, the term of this patent is extended or adjusted under 35 U.S.C. 154(b) by 0 days.

(21) Appl. No.: 09/716,444

(22) Filed: Nov. 21, 2000

(30) Foreign Application Priority Data

Nov. 23, 1999 (ES) ..... 9902957

(51) Int. Cl.[7] ..... F42B 12/34; F42B 12/02

(52) U.S. Cl. ..... 102/517; 102/501; 102/506; 102/508

(58) Field of Search ..... 102/439, 448, 102/501, 506–510, 517–519, 491–493; 244/3.23

(56) References Cited

U.S. PATENT DOCUMENTS

| | | | | | |
|---|---|---|---|---|---|
| 4,016,817 | A | * | 4/1977 | Arciniega Blanco | 244/3.23 |
| 4,301,733 | A | * | 11/1981 | Arciniega Blanco | 102/517 |
| 4,307,666 | A | * | 12/1981 | Baran | 102/501 |
| 4,413,564 | A | * | 11/1983 | Brown | 102/517 |
| 4,854,242 | A | * | 8/1989 | Katzmann | 102/506 |

FOREIGN PATENT DOCUMENTS

| | | | | |
|---|---|---|---|---|
| BE | 665259 | * | 6/1965 | 102/517 |
| DE | 734429 | * | 4/1943 | 102/517 |
| RU | 484383 | * | 9/1975 | 102/507 |
| RU | 1808115 | * | 4/1993 | 102/517 |

* cited by examiner

*Primary Examiner*—Harold J. Tudor
(74) *Attorney, Agent, or Firm*—Wenderoth, Lind & Ponack, L.L.P.

(57) ABSTRACT

A projectile for use in hunting is formed of a hard tapered first body, and second and third bodies disposed behind the first body. The three bodies are connected together by an axial stem extending rearwardly from the first body and a securing nut threaded onto its end to attach the bodies together. A chamber in the second body is closed by the first body. When the first body impacts a hard object, the chamber and air therein are pressurized to cause explosion of the second body to generate shrapnel. The outer surfaces of the second and third bodies have helical grooves for guidance and spinning of the projectile. At a rear end of the projectile, the outer surface is provided with an annular smooth area to fit complementarily with the smooth interior surface of the gun barrel, to prevent leakage of combustion gases.

18 Claims, 1 Drawing Sheet

SPINNING AND EXPLODING PROJECTILE

BACKGROUND OF THE INVENTION

The invention relates to a projectile to be launched by firearms used in big game hunting. The projectile is provided with a tip of hard material that is retained by means of a stem, integral with the tip, in the front part of a body formed by two parts coupled to each other by the stem itself, all of this with a number of particularities and novelties that will be disclosed in the course of the present specification, and among which can be cited that of being provided with several helical grooves in its lateral surface that, with an inclination similar to that of the rifled barrels, provide good stabilization of the projectile when it is launched, as well as a long range.

An object of the invention is to provide hunters with a projectile that, when impacting on an animal, produces either a deformation or an explosion of the front body of the projectile transforming it into shrapnel, to provide maximum effectiveness in use of the projectile.

Conventionally, the projectiles used in hunting guns have usually had a smooth external surface, which gives rise to a lack of stabilization in the discharge and also a range which is not very long.

Nevertheless, a projectile is known that is formed by two bodies, with the cooperation of a third, with the front body functioning as a front tip and being formed of a harder material than the body immediately to the rear, since the third body is of a plastic nature.

The body functioning as a tip is of conical configuration and its base is provided with an independent nut mounted on an axial stem extending rearwardly. The nut is housed in the mouth of a cavity, with which the front base of the second body is equipped for this purpose, usually with a cylindrical configuration and generally formed of lead.

The third body, or rear body, is coupled to the preceding one by means of projections of the front part of that third body, located in a rear recess of the second body, while the group of the three bodies forms a single piece by means of a rear nut fixed on the stem end, which presses against the external and rear base of the third body.

The body so constituted is also provided with helical grooves in the sense of generatrices to direct and stabilize the discharge of the projectile.

SUMMARY OF THE INVENTION

Based on the projectile type referred to in the above section, a number of improvements and innovations have been provided, from which derive remarkable advantages, as will be disclosed in the course of the present description.

One of the improvements of the projectile of the invention is that the end of the tip of hard material, preferably steel, is truncated instead of being pointed, i.e. the tip proper of the cone is truncated forming a tapered body. Also, the nut located in the mouth of the cavity corresponding to the base of the second (middle) lead body, has been omitted. Instead, the three bodies are fixed and retained together by means of a rear nut provided at the stem end, abutting against the rear base of the third body which has plastic properties.

Another novel characteristic presented by the projectile is that the general body, instead of being cylindrical, is slightly tapered, in which the diameter of the rear base is slightly larger than the diameter of the front base.

Another improvement is that the rear portion of the third body presents a flat end portion, which defines a smooth band in which terminate the ends of the grooves, that band fitting in the interior and completely smooth surface of the bore of the firearm, with the object of avoiding or preventing leakage of the gases generated in the explosion, obtaining thus greater effectiveness in the discharge.

Another improvement is that the second body, i.e. the one disposed between the hard tip and the rear plastic body, is provided over its entire length with a chamber or passage. With this chamber, when the projectile impacts on a hard part of an animal, the tip is compressed to thereby compress the air in the chamber to cause an explosion transforming the main body into shrapnel. If the impact occurs on a soft part of the animal, the body is deformed and expands to approximately a twofold increase of its diameter.

BRIEF DESCRIPTION OF THE DRAWINGS

To complement the description being presented, and with the object of further understanding the characteristics of the invention, in accordance with a preferred example of a practical embodiment of the same, a set of illustrative and not limiting drawings is attached as a part of this description, in which the following is represented.

DETAILED DESCRIPTION OF THE INVENTION

Figure 1:
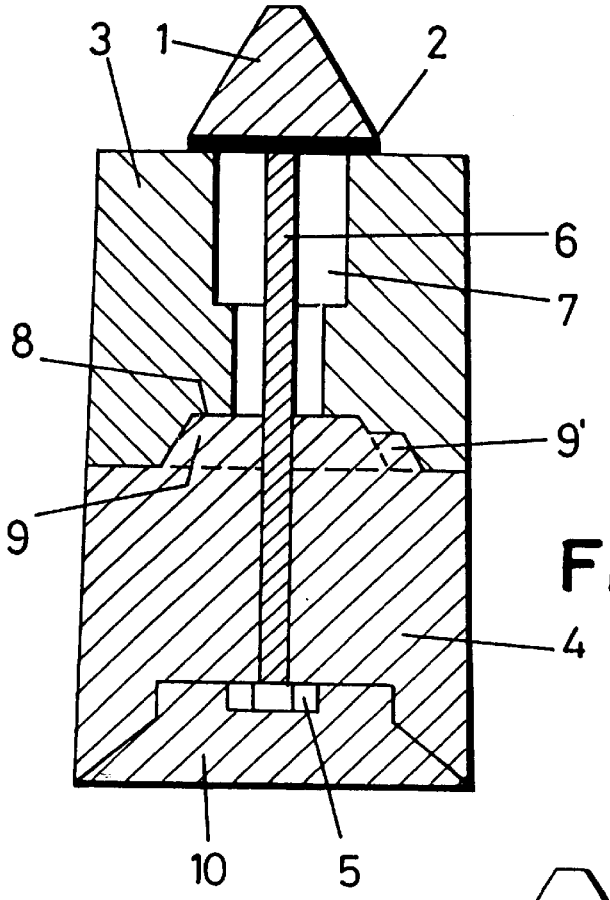
FIG. 1 shows a longitudinal sectional view of the projectile produced according to the invention.
Figure 2:
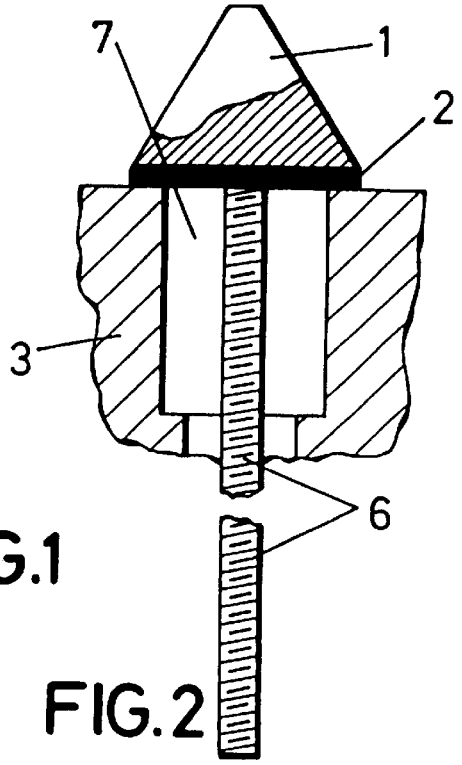
FIG. 2 shows a view in detail, also in longitudinal section, of a part of the projectile represented in FIG. 1.

As may be seen in the figures, the projectile of the invention is comprised of three bodies in close conformance with each other. A first one of the bodies forms a tip 1 of tapered configuration. The base of the tip 1 is disposed on the front face of a second body 3, preferably comprised of lead, with a support and sealing washer 2 disposed between the tip 1 and second body 3. The body 1 or tip is of greater hardness than the second body 3 and is preferably formed of steel. The third (or rear) body 4 is located following (i.e. behind) the body 3, and is of a plastic material having plastic properties. These bodies 1, 3 and 4 are attached by a stem 6 that projects from the base of the first body 1 and extends to the rear part of the body 4.

In the second body 3, i.e. between the tip 1 and the rear body 4, a chamber 7 is disposed whose function will be explained later. The second and third bodies 3, 4 are coupled together via a recess or cavity 8 formed in the second body at its base or rear portion, and a corresponding projection portion 9 protruding from the third body 4 and into the cavity 8. The projection portion 9 of the body includes an intrusion portion 9' which is positioned in a complementary cleft portion of the cavity 8.

The three bodies 1, 3 and 4 thus constituted are kept perfectly joined one to the other until the moment of impact.

Figure 3:
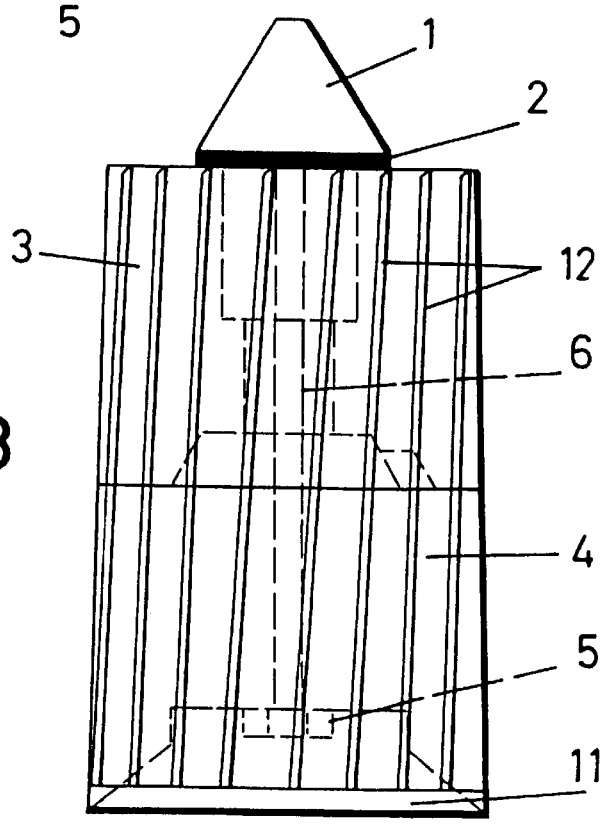
FIG. 3 shows a longitudinal elevation view of the same projectile of FIG. 1, showing the grooves in the longitudinal direction.

Opposite tip 1, which, as has been stated, is of a hard material, a closure cover 10 is provided that conceals an attachment nut 5 for securing the three bodies 1, 3 and 4 together. As shown in FIGS. 1 and 3 the second and third bodies 3, 4 together form an overall tapered shape such that the diameter of the front end of the second body 3 is of a smaller diameter than the rear end thereof and the front end of the body 4 which, in turn, are of a smaller diameter than the rear end of the third body 4. The closure cover 10 is received in a chamber formed in the rear end of the third body 4, and it is necessary for firing that the closure cover 10 fits accurately in the chamber and the projection portion 9 fits accurately in the cavity 8 to provide a hermetic coupling and avoid leakage of gases when the flanks of the third body 4 are compressed on the walls of the barrel of the weapon.

A number of helical grooves 12 are formed in the external lateral surface of both the second and third bodies 3 and 4 and these helical grooves 12 terminate at an annular smooth area or band 11 so that the overall body fits perfectly in the barrel of the weapon, avoiding the exit of the gases of the combustion powder when the discharge is carried out. The helical grooves 12 provide a spin of the projectile of approximately 3,000 rpm inside the firearm barrel, yielding not only a stabilization in the launching but high accuracy, avoiding to some extent the pull of earth's gravity, and giving rise to the fact that the projectile offers a gradient three times superior to that of the conventional ones, i.e. except for the spin, and with a range approximately twice that normally obtained.

The presence of air chamber 7 in the body 3 leads to the fact that when the projectile impacts on an item or animal, an explosion is produced that converts the second body 3 into shrapnel. Thus, at the moment of impact when the projectile touches, for example, a hard area or bone, the tip 1 of the projectile is pressed against the second body 3, thereby compressing the chamber 7 and giving rise to the air contained inside the chamber reaching a high pressure of up to 600 kg/cm$^2$, to cause an explosion of the second body 3 itself to transform it into shrapnel.

What is claimed is:

1. A projectile for use in a weapon having a barrel with a smooth internal surface, said projectile comprising:

a first body comprising a forwardly tapered tip having a front end and a rear end;

a second body having a front end and a rear end, said rear end of said first body resting on said front end of said second body;

a third body having a front end and a rear end, said rear end of said second body resting on said front end of said third body, such that said first, second and third bodies are aligned along an axial direction;

an axially elongated stem extending rearwardly from said rear end of said first body;

a securing member secured to a rear end of said stem, such that said second and third bodies are secured between said first body and said securing member; and a cover mounted to said rear end of said third body and concealing said securing member;

wherein an axial chamber is formed in said second body behind said first body.

2. A projectile according to claim 1, wherein said tapered tip is formed of a material harder than a material of said second body, and said third body is formed of a plastic material.

3. A projectile according to claim 2, wherein said material of said tapered tip comprises steel, and said material of said second body comprises lead.

4. A projectile according to claim 2, wherein said axial chamber opens through said front end of said second body and is closed in a sealed manner by said rear end of said first body.

5. A projectile according to claim 4, wherein said securing member comprises a nut threaded onto said rear end of said stem.

6. A projectile according to claim 1, wherein said axial chamber opens through said front end of said second body and is closed in a sealed manner by said rear end of said first body.

7. A projectile according to claim 1, wherein said securing member comprises a nut threaded onto said rear end of said stem.

8. A projectile according to claim 1, wherein said second and third bodies together form a forwardly tapered body.

9. A projectile according to claim 8, wherein helical grooves are formed in an outer surface of said forwardly tapered body to cause spinning of said projectile in the barrel of the weapon.

10. A projectile according to claim 9, wherein a smooth annular area is formed at a rear end of said outer surface of said forwardly tapered body to fit complementarily with the smooth interior surface of the barrel of the weapon, to prevent leakage of combustion gases.

11. A projectile according to claim 1, wherein said second and third bodies together have a continuous outer surface; and helical grooves are formed in said continuous outer surface to cause spinning of said projectile in the barrel of the weapon.

12. A projectile according to claim 11, wherein a smooth annular area is formed at a rear end of said continuous outer surface to fit complementarily with the smooth interior surface of the barrel of the weapon, to prevent leakage of combustion gases.

13. A projectile according to claim 1, wherein a smooth annular area is formed on an outer surface at a rear end of said second body to fit complementarily with the smooth interior surface of the barrel of the weapon, to prevent leakage of combustion gases.

14. A projectile according to claim 1, wherein said chamber is formed in said second body such that, upon impact of said first body with a hard object, air in said chamber is compressed to explode said second body to create shrapnel.

15. A projectile according to claim 14, wherein said axial chamber opens through said front end of said second body and is closed in a sealed manner by said rear end of said first body.

16. A projectile according to claim 1, wherein a cavity is formed in said rear end of said second body; and said front end of said third body has a projection portion which is complementary to said cavity and disposed in said cavity.

17. A projectile according to claim 16, wherein said cavity has a laterally projecting cleft; and said projection portion includes a laterally projecting intrusion portion complementary to said cleft and disposed in said cleft.

18. A projectile according to claim 1, wherein said rear end of said third body has a recess formed therein; and said cover is complementary to said recess and disposed in said recess.

* * * * *